US005291719A

United States Patent [19]

Buster

[11] Patent Number: 5,291,719

[45] Date of Patent: Mar. 8, 1994

[54] SUPPORT/GUIDE DEVICE FOR USE IN THE INSTALLATION OF HORIZONTALLY-DISPOSED SIDING

[76] Inventor: Claude Buster, 1103 S. 10th St., Merkel, Tex. 79536

[21] Appl. No.: 3,407

[22] Filed: Jan. 13, 1993

[51] Int. Cl.[5] ..... E04F 21/00

[52] U.S. Cl. ..... 52/749; 52/747; 52/748; 52/DIG. 1; 269/217; 269/904

[58] Field of Search ..... 52/749, DIG. 1, 747, 52/748; 269/217, 904

[56] References Cited

U.S. PATENT DOCUMENTS

| | | | |
|---|---|---|---|
| 3,357,464 | 12/1967 | Vroman | 52/749 |
| 3,490,152 | 1/1970 | Printz | 269/904 |
| 3,904,184 | 9/1975 | Krueger | 52/DIG. 1 |
| 4,089,141 | 5/1978 | Heroux | 52/DIG. 1 |
| 4,164,346 | 8/1979 | Sickler | 269/904 |
| 4,314,429 | 2/1982 | Casteel et al. | 52/749 |
| 4,795,141 | 1/1989 | Mulvaney | 269/904 |
| 4,836,517 | 6/1989 | Vossler | 269/904 |
| 4,862,669 | 9/1989 | Jacobsen | 52/749 |
| 5,190,266 | 3/1993 | Barrera | 269/904 |

*Primary Examiner*—Carl D. Friedman
*Assistant Examiner*—Christopher Todd Kent

[57] ABSTRACT

A device of novel design employed as a support and guide during the installation of horizontally-disposed building siding, said device comprising principally a shelf-like component and a means incorporating a camming action for clamping the shelf-like component onto an installed length of siding. When two or more of the devices are clamped vertically at spaced intervals onto the uppermost length of installed siding, the shelf-like components provide a horizontal base on which the siding to be installed at the next higher level can be supported during installation, thereby enabling an installer to work alone. The shelf-like components further function to correctly position the siding to be installed relative to the siding already in place without the need for constant measuring and leveling. The device operates in a quick, easy and trouble-free manner, and it assures efficient, accurate and uniform siding installation.

3 Claims, 2 Drawing Sheets

SUPPORT/GUIDE DEVICE FOR USE IN THE INSTALLATION OF HORIZONTALLY-DISPOSED SIDING

BACKGROUND OF THE INVENTION

The present invention relates to a device of novel design for use in the installation of horizontally-disposed siding to the exterior surface of structures, two or more of the devices functioning to support and precisely position a length of siding during installation. Without the aid of such tools, the procedure for the installation of horizontally-disposed siding requires much careful measuring, leveling, marking and monitoring to assure that the individual lengths of siding are properly and uniformly positioned relative to the rest. Not only is said procedure time and labor inefficient, but it also provides abundant opportunities for human error. What the present invention provides is a quick, easy and virtually foolproof approach to the installation of horizontally-disposed siding.

PRIOR ART

The following patents are cited as exemplary of the U.S. prior art. All of them present tools which allow one person to accomplish what otherwise might necessitate more than one to accomplish. U.S. Pat. No. 3,904,184, Krueger and U.S. Pat. No. 4,089,141, Heroux both show an alignment/support tool for the installation of building siding, said tool being nailed to the wall and subsequently removed. U.S. Pat. No. 3,490,152, Printz presents a building siding application tool which is temporarily held in place by clamping contact of its lower portion with the front and back planar surfaces of the lower portion of the topmost installed siding board. U.S. Pat. No. 4,164,346, Sickler describes a lap siding installation tool which is temporarily supported in place by downward facing abutment screws resting on the upper marginal edge of the topmost installed siding board. U.S. Pat. No. 4,314,429, Casteel et al. present a device for supporting lap siding during installation, said device including a hook which engages the device by temporarily hooking over the top edge of the topmost installed siding board. U.S. Pat. No. 4,862,669, Jacobsen shows an alignment and support tool for installing building siding, said tool being temporarily held in place by wedging its hook-like lower extremity underneath the bottom edge of an already installed siding board. U.S. Pat. No. 4,836,517, Vossler shows a carpenter's tool for temporarily supporting a fascia board during installation thereof, said tool being attached to the fascia board by activating threaded clamp-like means. U.S. Pat. No. 5,190,266, Barrera shows a tool for straightening and properly spacing a decking board prior to securing it to an underlying joist, the clamping action of said tool being activated by a lever handle. U.S. Pat. No. 3,357,464, Vroman shows a carpenter's tool for holding two perpendicular wood members in position while they are being toenailed together, the clamping action of said tool being activated by means of a hammer blow and is deactivated with a lever. U.S. Pat. No. 4,795,141, Mulvaney also shows a fixture to prevent major displacement of wood framing members while toenailing them, said fixture being temporarily locked into place by a lever-activated camming action.

Although the principle of the cam is old art, it continues to be utilized advantageously in a myriad of applications including the cited fixture of Mulvaney, but this useful principle apparently has not been employed heretofore in a tool to align and support building siding during installation. The present invention, however, does incorporate the merits of a cam-induced clamping action to present a building siding installation tool of unique design.

OBJECTS OF THE INVENTION

It is the primary object of the present invention to provide a support/guide device which facilitates efficient and precise installation of horizontally-disposed building siding. In accordance with its primary object, a more specific object of this invention is to provide a siding installation device which, when engaged, automatically furnishes accurate position for the installation of a length of siding, thereby eliminating the need for measuring and leveling. A related object is to provide such a device which, when used in pairs, holds a length of siding in proper position during installation, thereby enabling an installer to work alone with relative ease, and still achieve professional results.

Another object of this invention is to provide a siding installation device of novel design including a camming action which permits quick and easy engagement and disengagement of the device. A related object is to provide such a device which remains securely and immobily in place during use without loosening or misaligning, and which does not mar the siding piece onto which it is clamped. A final object of the present invention, in accordance with those preceding, is to provide a relatively durable, economical and trouble free siding installation device.

SUMMARY OF THE INVENTION

The support/guide device herein described is a nonlimitative exemplary embodiment of the present invention primarily comprising 1) a shelf-like component for supporting and correctly positioning a length of horizontally-disposed siding during installation and 2) means for clamping said shelf-like component onto the topmost length of siding already installed.

The clamping means includes two vertical strap-type bodies disposed end to end flat against a vertical base component. The upper body is affixed to the base and the lower body is moveable vertically along said base. A lever-activated camming means moves the lower body upward, causing a horizontal lip at the outward extremity of each body to tension against the transverse edges of the topmost length of installed siding, thereby clamping the device into operational position. The upper body has a horizontal shelf-like component affixed to it which, in pairs, provide support and accurate positioning for a length of siding during installation.

The present invention can expedite the installation procedure for horizontally-disposed siding by facilitating efficiency and accuracy. The afore-mentioned objects of the present invention, as well as its other advantages, will become more apparent to those skilled in the art by referring to the following detailed description of the preferred embodiment, especially when viewed in light of the appended drawings.

DETAILED DESCRIPTION OF THE PREFERRED EMBODIMENT

The following description and the appended drawings present a preferred embodiment of the invention, but it should be understood that the present specification is only exemplary of the principles and essence of the invention and is not intended to limit the invention to the specific embodiment herein described and illustrated. The true scope and range of the invention is detailed in the appended claims.

Figure 2:
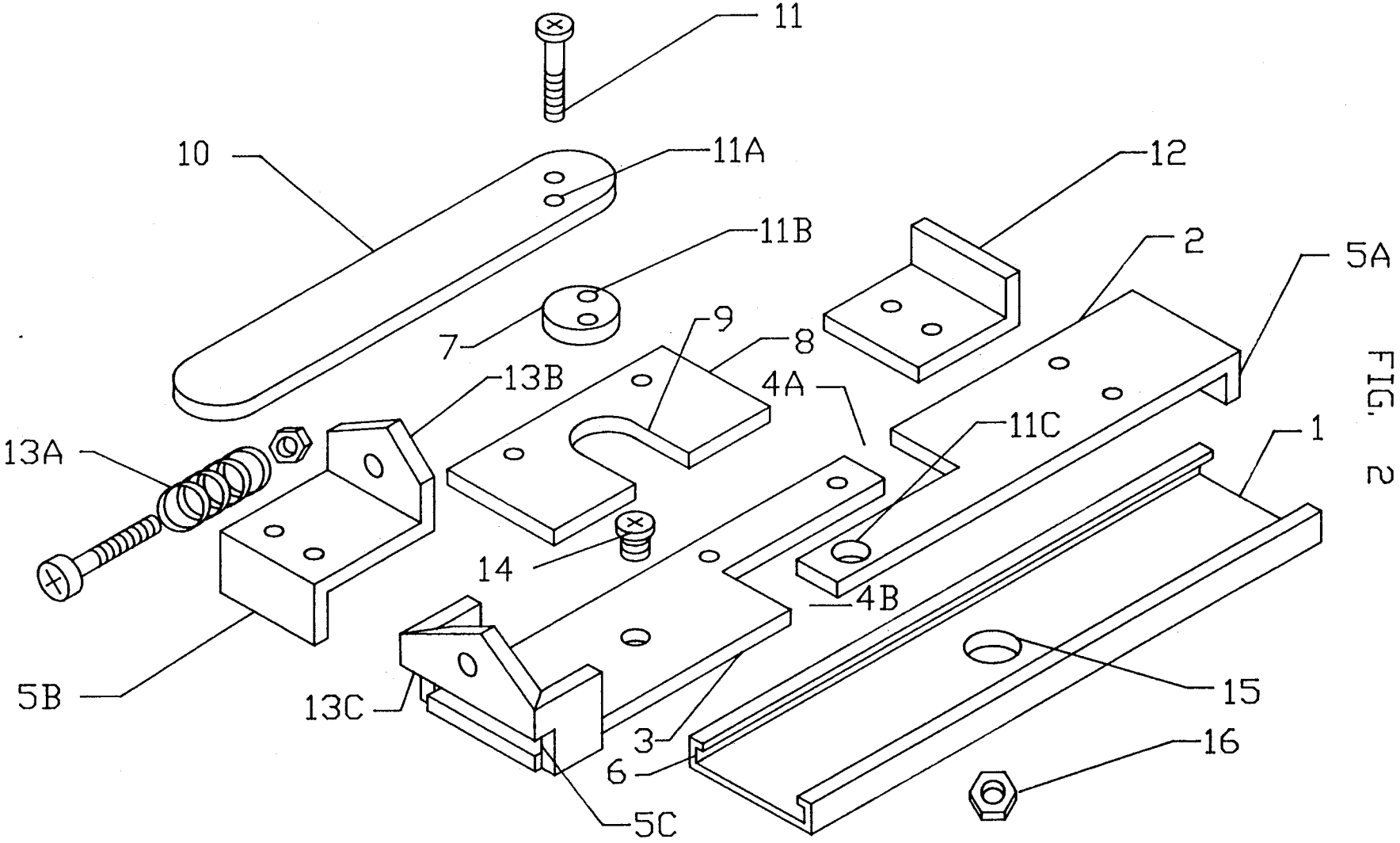
FIG. 2 is an exploded perspective view of the device of FIG. 1 showing the individual components of the device and their physical relationship to each other and to the whole.

First, the support/guide device herein presented as the preferred embodiment of the present invention will be described in terms of its construction. Referring to FIG. 2, the lengths of bodies 1, 2 and 3 are shown disposed in the same direction. Body 1 functions as a base, and body 2 is affixed flat atop it, overlapping one end. Body 3 is also disposed flat atop body 1, being opposite of body 2 and overlapping the other end of 1. A channel 6 is provided to help hold body 3 in place while still allowing body 3 to move lengthwise along the surface of body 1. Both body 2 and body 3 have a substantially rectangular void, 4*a* and 4*b* respectively, at their inward extremity, the two said voids being diagonally opposed to each other such that the inward extremities of bodies 2 and 3 form a halved joint. At their outward extremities, bodies 2 and 3 are provided with means 5*a* and 5*b*, respectively, for pressing inwardly against the transverse edges of the topmost installed length of horizontally-disposed siding (not shown), and thereby clamping the device vertically onto said siding.

Disposed atop the inward extremities of bodies 2 and 3 is camming disk frame 8 which is affixed to the inward extremity of body 3. Camming disk frame 8 is provided with a void 9 for accommodating camming disk 7. Camming disk 7 is disposed on substantially the same plane as camming disk frame 8 and atop the juncture of the inward extremities of bodies 2 and 3.

Disposed atop and affixed to camming disk 7 is means 10 for activating the clamping action (described below) of the preferred embodiment. Means 11 provides a pivotal axis on which clamping-activation means 10 and camming disk 7 can rotate. Clamping-activation means 10 and camming disk 7 are designed to rotate in unison but not independently of one another. Clamping-activation means 10, camming disk 7 and the inward extremity of body 2 are perforated at 11*a*, 11*b* and 11*c* respectively to accommodate pivotal-axis means 11. If desired, means such as 15 and 16 can also be provided to secure in place pivotal-axis means 11.

Affixed to body 2 near its outward extremity is shelf-like means 12 for supporting the bottom edge of a length of siding while the top portion of said siding is being affixed to the structure. Shelf-like means 12 also correctly positions the length of siding being installed relative to the siding already in place. With the device disposed in operational position (i.e., clamped vertically onto the topmost length of installed siding), the shelf portion of means 12 is substantially parallel to the transverse edges of installed siding (not shown). As desire, edge-pressing means 5*a* and shelf-like means 12 can be constructed separately or as a single unit.

If desired, means such as 13*a*, 13*b* and 13*c* can be provided to prevent the clamping force of means 5*a* and 5*b* from marring the transverse edge of the siding. Means 13*c* is affixed to the outward extremity of body 3. Slot-like opening 5*c* is provided between body 3 and means 13*c* for the passage of edge-pressing means 5*b* during assembly of the device. Compression-spring means 13*a* affixes means 13*c* to means 13*b*. Means 14 is affixed to body 3 at the strategic location for optimally stopping the rotation of the clamping-activation means 10.

Figure 1:
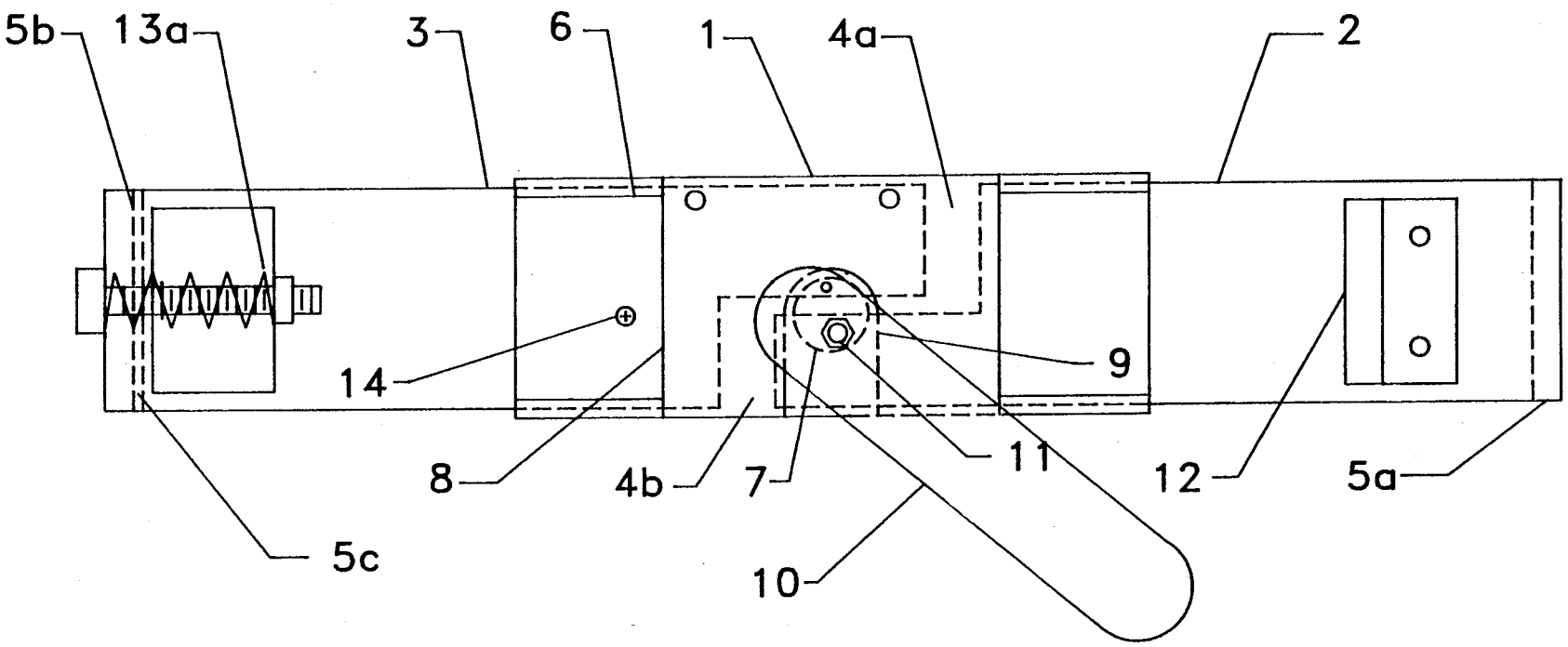
FIG. 1 is a plan view of the herein specified support/guide device for use in the installation of horizontally-disposed siding.

Description will now be made of the procedure for installing and utilizing the support/guide device having the above-described construction. Referring to FIG. 1, the device is installed by placing it vertically so that it spans the height of the topmost length of installed horizontally-disposed siding (not shown) with edge-pressing means 5*a* and 5*b* extending toward the structure (not shown), 5*a* being disposed on or just above the top edge of said siding and 5*b* being disposed just below the bottom edge of said siding. Upon rotation of clamping-activation means 10, a camming action is produced in which camming disk 7 pushes camming disk frame 8 and body 3 upward toward body 2, thereby tensioning edge-pressing means 5*a* and 5*b* sufficiently against the top and bottom edges respectively of the siding so that the device is clamped onto the siding. The rotation of clamping-activation means 10 can be stopped optimally by means 14. Means 13*a*, 13*b* and 13*c* can attenuate the force transferred from edge-pressing means 5*a* and 5*b* to the siding edges, thereby preventing damage to said edges.

By similarly clamping one or more additional units of the device at spaced intervals onto the same length of siding, the shelf-like means 12 of the devices provide a horizontal base on which to set the bottom edge of the length of siding to be installed on the next higher level. Shelf-like means 12 are so disposed that the length of siding set upon them is automatically in proper vertical and horizontal position for installation, thereby obviating the need for leveling and measuring. After the upper portion of the length of siding being installed has been affixed to the structure, the support/guide devices are removed so that the affixing of said length of siding to the structure can be completed.

A preferred embodiment of the present invention has now been described in detail. Since many changes and modifications to said embodiment are possible without departing from the spirit of the invention, the scope of the present invention is not to be limited to the foregoing details, except as set forth in the appended claims.

What is claimed is:

1. A support/guide device for use in the installation of horizontally-disposed building siding comprising:

a first upstanding, rigid and substantially rectangular strap-type body defining a plane, said first body having a length dimension terminating in upper and lower ends, said first body additionally having substantially parallel planar front and rear surfaces, said surfaces having upper and lower portions;

a second upstanding, rigid and substantially rectangular strap-type body defining a plane, said second body having a length dimension terminating in upper and lower ends, said second body additionally having substantially parallel planar front and rear surfaces, said surfaces having upper and lower portions, the lower portion of the rear surface of said second body engaging the upper portion of the front surface of said first body, said second body overlapping the upper end of said first body, said second body being affixed to said first body;

a third upstanding, rigid and substantially rectangular strap-type body defining a plane, said third body having a length dimension terminating in upper and lower ends, said third body additionally having substantially parallel planar front and rear surfaces, said surfaces having upper and lower portions, the length dimension of said third, second and first bodies being disposed in substantially the same direction, the upper portion of the rear surface of said third body engaging the lower portion of the front surface of said first body, said third body overlapping the lower end of said first body, said third body and said second body being disposed rectilinearly to one another and together substantially defining a plane, said third body and said second body having a width dimension of substantially equal extend, each said width dimension being divisible into left and right halves, there being substantially rectangular voids eliminating approximately the right half of the width of the upper end of said third body and the left half of the width of the lower end of said second body, said voids being diagonally opposed to each other in a configuration resembling a halved joint;

means for engaging and pressing inwardly against the transverse edges of a length of horizontally-disposed siding, said edge-pressing means being at the upper end of said second body and at the lower end of said third body;

means for providing a channel to help hold said third body in place against said first body, said channel providing a path for the vertical movement of said third body along the lower portion of the front surface surface of said first body;

camming means disposed atop the lower portion of the front surface of said second body, and atop the upper portion of the front surface of said third body;

plate-like camming means frame disposed atop the lower portion of the front surface of said second body and atop the upper portion of the front surface of said third body, said frame being affixed to said third body, said frame having avoid to accommodate said camming means, said frame and said camming means together substantially defining a plane;

means for activating the clamping action of the device, said clamping-activation means being disposed atop said camming means and affixed to it, said clamping-activation means and said camming means being rotatable jointly but not independently of one another;

means for providing an axis on which said clamping-activation means and said camming means can pivot, said axial means perforating said clamping-activation means, said camming means and said second body;

shelf-like means for supporting and positioning a length of siding for installation, said shelf-like means being affixed to the upper portion of the front surface of said second body;

wherein upon placing the device vertically with the edge-pressing means spanning the height of the topmost length of installed siding and extending toward said siding, the second body being upward and the clamping-activation means outward, and wherein upon rotation of the clamping-activation means, the camming means pushes the camming means frame and the third body toward the second body, thereby clamping the device in operational position onto the siding by tensioning the edge-pressing means inwardly against the transverse edges of the siding; and wherein upon similarly installing at spaced intervals on the same length of siding one or more additional units of the device, the shelf-like means thereupon provide a base to support and position siding for installation on the next higher level.

2. The support/guide device for use in the installation of horizontally-disposed building siding of claim 1 further comprising means for attenuating the force transferred from said edge-pressing means to the transverse edges of a length of siding, said force-attenuation means being disposed at or near the lower end of said third body.

3. The support/guide device for use in the installation of horizontally-disposed building siding of claim 1 further comprising means for optimally stopping the rotation of said clamping-activation means, said rotation-stopping means being affixed to the front surface of said third body.

* * * * *